US007971878B2

(12) United States Patent
Hashimoto et al.

(10) Patent No.: US 7,971,878 B2
(45) Date of Patent: Jul. 5, 2011

(54) SHEET CONVEYING DEVICE AND IMAGE FORMING APPARATUS

(75) Inventors: Takashi Hashimoto, Kanagawa (JP); Toshiyuki Andoh, Kanagawa (JP); Takashi Hodoshima, Kanagawa (JP); Seiji Hoshino, Kanagawa (JP); Hidetaka Noguchi, Hyogo (JP); Tatsuhiko Oikawa, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 93 days.

(21) Appl. No.: 12/320,868

(22) Filed: Feb. 6, 2009

(65) Prior Publication Data

US 2009/0212488 A1 Aug. 27, 2009

(30) Foreign Application Priority Data

Feb. 27, 2008 (JP) ..... 2008-045935

(51) Int. Cl.
*B65H 5/02* (2006.01)
*B65H 5/04* (2006.01)

(52) U.S. Cl. ..... 271/274; 271/270; 271/265.01; 271/265.02; 198/624

(58) Field of Classification Search ..... 271/270–275, 271/276, 265.01, 265.02, 176; 198/624
See application file for complete search history.

(56) References Cited

U.S. PATENT DOCUMENTS

| | | | | |
|---|---|---|---|---|
| 5,076,568 | A * | 12/1991 | de Jong et al. | 271/275 |
| 7,547,016 | B2 * | 6/2009 | Mizuno | 271/264 |
| 2007/0269230 | A1 | 11/2007 | Hoshino et al. | |
| 2008/0175612 | A1 | 7/2008 | Oikawa et al. | |
| 2008/0232880 | A1 * | 9/2008 | Noguchi et al. | 399/397 |
| 2008/0303202 | A1 | 12/2008 | Noguchi et al. | |
| 2009/0212491 | A1 * | 8/2009 | Noguchi et al. | 271/265.04 |

FOREIGN PATENT DOCUMENTS

JP 2006-085153 3/2006

* cited by examiner

*Primary Examiner* — Stefanos Karmis
*Assistant Examiner* — Prasad V Gokhale
(74) *Attorney, Agent, or Firm* — Harness, Dickey & Pierce, PLC

(57) ABSTRACT

A sheet conveying device includes a torque estimation unit that, based upon a first load torque generated at a time that a sheet-like member passes through a first nip between a first driving roller and a first driven roller of an upstream sheet conveying unit, estimates a second load torque generated at a time that the sheet-like member passes through a second nip between a second driving roller and a second driven roller of a downstream sheet conveying unit; and a control unit that controls the driving torque such that the second load torque is counterbalanced by applying a counterbalancing torque in synchronization with a timing of entry of the sheet-like member into the second nip.

10 Claims, 12 Drawing Sheets

| ELAPSED TIME [sec] | ROLLER TORQUE [N·m] |
|---|---|
| t3 | T2 |
| t4 | T3 |
| t5 | T4 |
| t6 | T5 |
| t7 | T6 |
| t8 | T7 |

| ELAPSED TIME [sec] | ROLLER TORQUE [N·m] |
|---|---|
| 0 | T2 |
| tc | T3 |
| 2tc | T4 |
| 3tc | T5 |
| 4tc | T6 |
| 5tc | T7 |

| ELAPSED TIME [sec] | ROLLER TORQUE [N·m] |
|---|---|
| 0 | T2-Tth |
| tc | T3-Tth |
| 2tc | T4-Tth |
| 3tc | T5-Tth |
| 4tc | T6-Tth |
| 5tc | T7-Tth |

| ELAPSED TIME [sec] | ROLLER TORQUE [N·m] |
|---|---|
| 0 | 0 |
| tc | T2-Tth |
| 2tc | T3-Tth |
| 3tc | T4-Tth |
| 4tc | T5-Tth |
| 5tc | T6-Tth |
| 6tc | T7-Tth |
| 7tc | 0 |

| ELAPSED TIME [sec] | ROLLER TORQUE [N·m] |
|---|---|
| 0 | 0 |
| tc | \|T2-Tth\| |
| 2tc | \|T3-Tth\| |
| 3tc | \|T4-Tth\| |
| 4tc | \|T5-Tth\| |
| 5tc | \|T6-Tth\| |
| 6tc | \|T7-Tth\| |
| 7tc | 0 |

| ELAPSED TIME [sec] | ROLLER TORQUE [N·m] |
|---|---|
| 0 | 0 |
| b*tc | a*\|T2-Tth\| |
| b*2tc | a*\|T3-Tth\| |
| b*3tc | a*\|T4-Tth\| |
| b*4tc | a*\|T5-Tth\| |
| b*5tc | a*\|T6-Tth\| |
| b*6tc | a*\|T7-Tth\| |
| b*7tc | 0 |

SHEET CONVEYING DEVICE AND IMAGE FORMING APPARATUS

CROSS-REFERENCE TO RELATED APPLICATIONS

The present application claims priority to and incorporates by reference the entire contents of Japanese priority document 2008-045935 filed in Japan on Feb. 27, 2008.

BACKGROUND OF THE INVENTION

1. Field of the Invention

The present invention relates to a sheet conveying device and an image forming apparatus that employs the sheet conveying device.

2. Description of the Related Art

In an image forming apparatus, an original reading apparatus, and the like, various kinds of sheet-like members such as a printing paper, a thin paper, a thick paper, a postcard, and an envelop (hereinafter collectively, "sheet") are used. With such a wide variation of the sheet, when a sheet thicker than a certain thickness enters into a pair of conveyor rollers, a fixing unit, or a transfer unit, the operating speed of a sheet conveying unit that has been operating at a constant rate drops temporarily, leading to various problems such as image distortion. A conveying roller, a fixing roller, an image carrier, and an intermediate transfer unit are exemplified as the sheet conveying unit.

Specifically, an intermediate-transfer-type image forming apparatus may have image distortion at a primary-transfer unit due to temporal speed drop of the intermediate transfer unit when a sheet thicker than a certain thickness enters into the conveying rollers or a secondary-transfer unit.

Furthermore, for a color image forming apparatus configured such that the secondary-transfer unit and the fixing unit are closely arranged to each other to downsize the apparatus, transferring and fixing of an image is being concurrently performed on a sheet. In other words, when an image is being transferred onto a trailing edge of a sheet, an image that has been transferred onto a leading edge of the sheet is fixed. In such a color image forming apparatus, distortion may occur in the image at the secondary-transfer unit due to temporal speed drop of a fixing roller or a fixing belt when a sheet thicker than a certain thickness enters into the fixing unit.

Moreover, in a concurrent transferring/fixing image forming apparatus that performs transferring and fixing of a toner image onto a sheet at a time, distortion occurs in the image at the primary-transfer unit and the secondary-transfer unit due to temporal speed drop of the intermediate transfer unit when a sheet thicker than a certain thickness enters into the transferring/fixing unit.

To address these problems, Japanese Patent Application Laid-open No. 2006-85153 discloses a technology in which speed of an endless belt is kept constant by varying amount of speed control of a driving source for the belt based on a predetermined timing, a predetermined amount, and a predetermined time.

However the technology in Japanese Patent Application Laid-open No. 2006-85153 has a problem in that optimum control on all usable sheets is difficult because preset control target values are used corresponding to the thickness or the kind of the sheets.

Even the same sheet may have a change in its texture or in thickness depending on an environment to be used such as humidity, causing different types of the speed fluctuations, so that optimum controlling of the speed fluctuation is difficult.

Furthermore, a storage area for storing such control target values to deal with various kinds of sheets is needed. For improving capabilities of handling sheets, a storage unit having a larger storage capacity is required.

SUMMARY OF THE INVENTION

It is an object of the present invention to at least partially solve the problems in the conventional technology.

According to an aspect of the present invention, there is provided a sheet conveying device including a first sheet conveying unit that is located upstream in a sheet conveying direction and that includes a first driving roller and a first driven roller; a second sheet conveying unit that is located downstream in the sheet conveying direction, that includes a second driving roller and a second driven roller, and of which a driving torque is controllable; a torque estimation unit that, based upon a first load torque generated at a time that a sheet-like member passes through a first nip between the first driving roller and the first driven roller, estimates a second load torque generated at a time that the sheet-like member passes through a second nip between the second driving roller and the second driven roller; and a control unit that controls the driving torque such that the second load torque is counterbalanced by applying a counterbalancing torque in synchronization with a timing of entry of the sheet-like member into the second nip.

According to another aspect of the present invention, there is provided an image forming apparatus including the above sheet conveying device.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
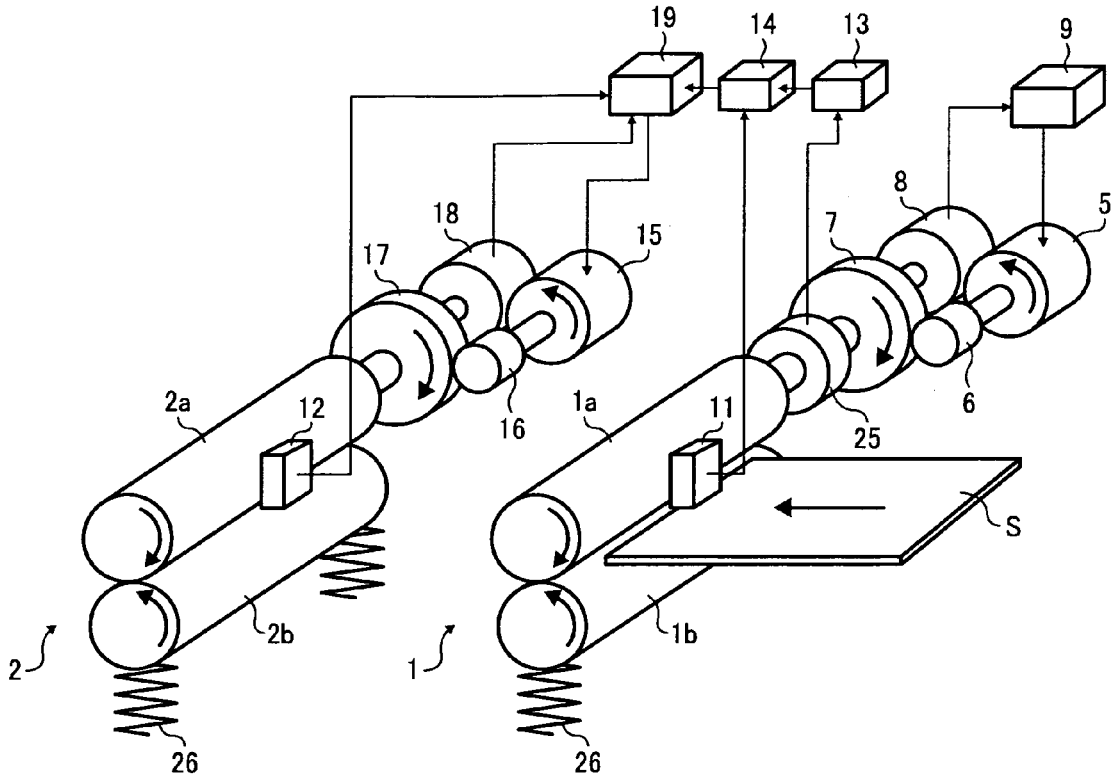
FIG. 1 is a schematic diagram of a sheet conveying device according to a first embodiment of the present invention.

FIG. 1 is a schematic diagram of a sheet conveying device according to a first embodiment of the present invention. As shown in FIG. 1, the sheet conveying device includes a pair of upstream rollers 1 serving as a first sheet conveying unit arranged on the upstream side and a pair of downstream rollers 2 serving as a second sheet conveying unit arranged on the downstream side. The upstream rollers 1 are configured with a driving roller 1*a* and a driven roller 1*b*, and the downstream rollers 2 are configured with a driving roller 2*a* and a driven roller 2*b*. Each of the driven rollers 1*b* and 2*b* is in pressure contact with a corresponding one of the driving rollers 1*a* and 2*a* by a pressing unit 26. Sheet detecting units 11 and 12 are arranged on the upstream side of the upstream rollers 1 and the downstream rollers 2, respectively. The upstream rollers 1 and the downstream rollers 2 convey a sheet S from right to left in FIG. 1 while nipping the sheet S. The sheet conveying device can include three or more sheet conveying units.

The driving roller 1*a* is driven by a driving source 5 via a small-diameter gear 6 and a large-diameter gear 7. The driven roller 1*b* is in pressure contact with the driving roller 1*a* to rotate together with the driving roller 1*a*. A speed measuring unit 8 is attached to the large-diameter gear 7, and the output from the speed measuring unit 8 is sent to a control unit 9 that controls the driving source 5. A torque measuring unit 25 is arranged between the driving roller 1*a* and the large-diameter gear 7 to measure a torque at the time that the sheet S is nipped at a nip portion between the driving roller 1*a* and the driven roller 1*b*, i.e., at the time that the sheet S passes through the nip portion. The output from the torque measuring unit 25 is sent to a storing unit 13 and the output from the sheet detecting unit 11 is sent to a calculating unit 14.

The driving roller 2*a* is driven by a driving force from a driving source 15 via a small-diameter gear 16 and a large-diameter gear 17. The driven roller 2*b* is in pressure contact with the driving roller 2*a* to rotate together with the driving roller 2*a*. A speed measuring unit 18 is attached to the large-diameter gear 17, and the output from the speed measuring unit 18 is sent to a control unit 19 that controls the driving source 15. The output from the sheet detecting unit 12 is also sent to the control unit 19.

Although the driving rollers 1*a* and 2*a*, and the driven rollers 1*b* and 2*b* are metallic, the surfaces of the driving rollers 1*a* and 2*a* and the driven rollers 1*b* and 2*b* can be coated with an organic material.

For the driving sources 5 and 15, a direct current (DC) motor, a pulse motor, an ultrasonic motor, a direct drive motor, or the like is typically employed. In the first embodiment, a torque at the time that the sheet S is nipped between the downstream rollers 2 is controlled by the driving source 15, so that the DC motor is applied for the driving source 15. The driving source 5 is used for measuring a torque at the time of nipping the sheet S by the upstream rollers 1, so that any one of the above motors can be used.

In the sheet conveying device according to the first embodiment, a drive transmission system from each driving source to each driving roller is configured with gears; however, for example, a gear and a tooth belt, a V-belt and a pulley, or an epicyclic gear can be employed instead. Furthermore, when an ultrasonic motor or a direct drive motor is used for the driving sources 5 and 15, rollers can be directly driven without using the drive transmission system because of the features of such motors.

The control unit 9 includes a feedback controller and a phase compensating unit. The feedback controller controls the driving source 5 by calculating such as driving voltage, driving current, and driving frequency of the driving source 5 based on speed information of the large-diameter gear 7 measured by the speed measuring unit 8.

When the driving source 5 is a DC motor or a direct drive motor, a driving current control method or a pulse-width modulation (PWM) method is employed for the driving source 5. When the driving source 5 is a pulse motor or an ultrasonic motor, a driving frequency control method is employed for the driving source 5. Because a DC motor is applied to the driving source 15 to control the torque at the time of nipping the sheet S, the driving current control method is employed for the driving source 15.

For the speed measuring units 8 and 18, a magnetic encoder that measures magnetic information of such as a rotor of each of the driving sources 5 and 15 by a magnetic sensor can be applied. When a DC motor is employed for the driving sources 5 and 15, the speed measuring units 8 and 18 can use a frequency generator (FG) signal that is output from the DC motor. Alternatively, the speed measuring units 8 and 18 can measure a driving current of the DC motor.

The use of the pulse motor or the ultrasonic motor for the driving source 5 enables driving by open-loop controlling only without feedback controlling. The phase compensating unit adjusts control bandwidth or gain.

Figure 2:
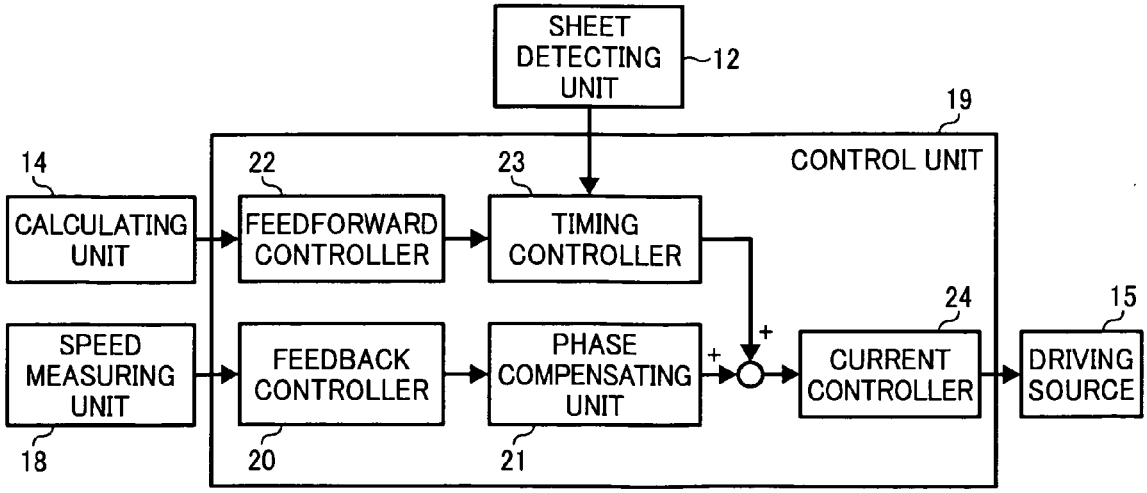
FIG. 2 is a block diagram explaining a configuration of a control unit for a pair of downstream rollers shown in FIG. 1.

FIG. 2 is a block diagram of a configuration of the control unit 19 for the downstream rollers 2. As shown in FIG. 2, the control unit 19 includes a feedback controller 20, a phase compensating unit 21, a feedforward controller 22, a timing controller 23, and a current controller (current feedback controller) 24. The feedback controller 20 calculates the driving current of the driving source 15 based on speed information of the large-diameter gear 17 measured by the speed measuring unit 18. The current feedback controller 24 performs feedback control of the driving current of the driving source 15 to conform to the driving current calculated by the feedback controller 20.

The feedforward controller 22 converts a torque control target value calculated by the calculating unit 14 into a current value by dividing by torque constant of the driving source 15. The detail of the feedforward controller 22 is explained later.

The timing controller 23 performs a timing control to delay a command value output from the feedforward controller 22 for a predetermined time and outputs the delayed command value. The delay time is the time from detecting of the sheet S by the sheet detecting unit 12 to entering of the sheet S into a nip portion between the driving roller 2*a* and the driven roller 2*b*. Instead of the use of the sheet detecting unit 12, speed fluctuation data or an operation signal of the upstream rollers 1 can be used for detecting the sheet S.

Figure 3:
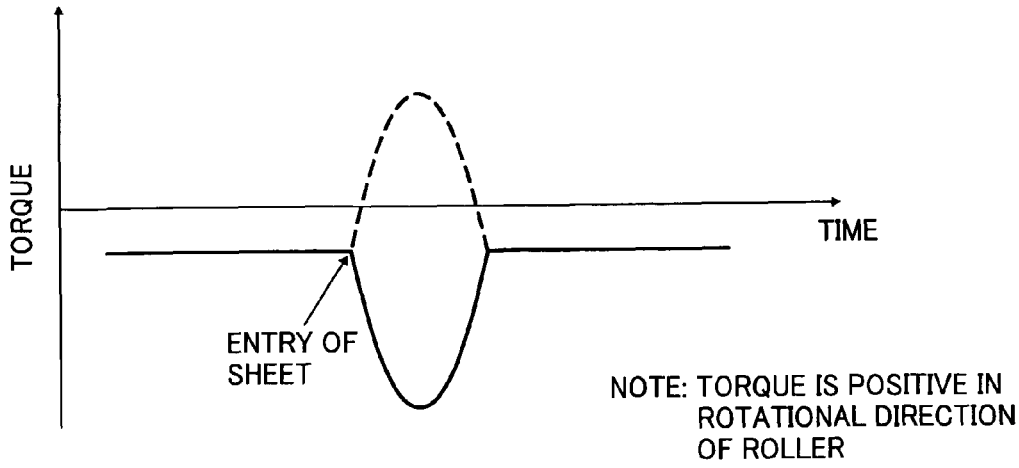
FIG. 3 is a conceptual view of a method for controlling torque.

FIG. 3 is a conceptual diagram of a method for controlling torque according to the first embodiment. When the sheet S thicker than a certain thickness enters into a pair of rollers, speed of the rollers that have been driving at a constant rate drops temporarily. That is, as shown by a continuous line in FIG. 3, a load torque is generated at the time that the sheet S is nipped between the downstream rollers 2, so that the speed of the downstream rollers 2 drops. To counterbalance the speed fluctuation, a torque for counterbalancing the load torque at the time that the sheet S is nipped between the downstream rollers 2 is applied to the driving roller 2*a* in synchronization with the timing of entry of the sheet S into the downstream rollers 2 as shown by a dashed line in FIG. 3. This driving control enables counterbalancing the speed fluctuation caused by the entry of the sheet S. The torque target value to be applied to the downstream rollers 2 as shown by the dashed line in FIG. 3 is obtained by converting the pre-detected load toque at the time that the sheet S is nipped between the upstream rollers 1.

The method for controlling torque is specifically explained below.

When the sheet S thicker than a certain thickness enters into the upstream rollers 1, torque of the driving roller 1*a* fluctuates as shown by the continuous line in FIG. 3. If the upstream rollers 1 and the downstream rollers 2 have an identical construction, when the same sheet S from the upstream rollers 1 enters into the downstream rollers 2, the same torque fluctuation as shown by the continuous line in FIG. 3 occurs. Therefore, a torque control target value for counterbalancing the torque fluctuation of the downstream rollers 2 can be obtained by obtaining the torque fluctuation data of the upstream rollers 1.

However, if the upstream rollers 1 and the downstream rollers 2 are configured with different roller diameters or pressing forces, different waveforms of the torque fluctuation are generated between the upstream rollers 1 and the downstream rollers 2. A method for converting a sheet nipping torque in such a case is explained below.

A load torque generated when the sheet S is nipped by a pair of rollers in a pressure contact state is considered.

Figure 4:
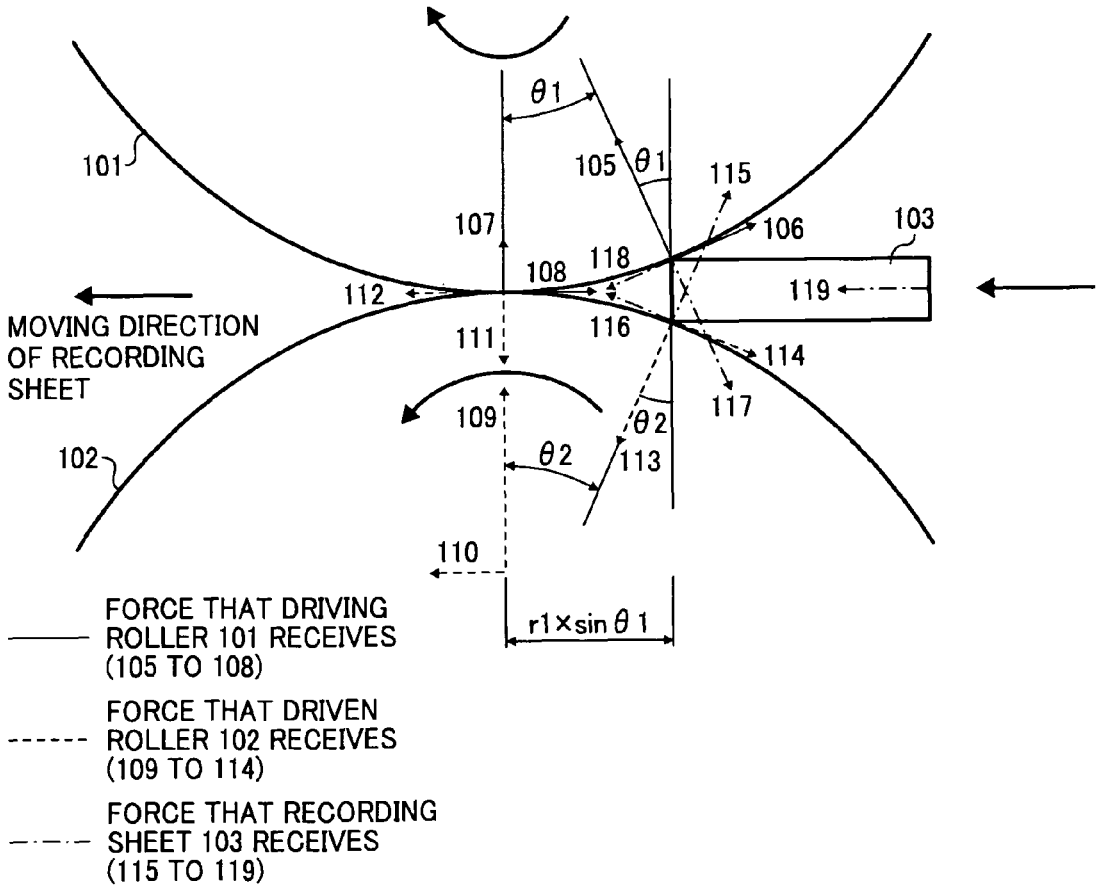
FIG. 4 is a schematic diagram for explaining a relation of dynamical forces when a sheet enters into a nip of a pair of rollers.

FIG. 4 is a schematic diagram for explaining a relation of dynamic forces when a recording sheet 103 enters into a nip portion between a driving roller 101 and a driven roller (pressure roller) 102. In FIG. 4, a force 105 is a normal force N1 that the driving roller 101 receives from the recording sheet 103, a force 106 is a friction force R1 that the driving roller 101 receives from the recording sheet 103, a force 107 is a normal force N3 that the driving roller 101 receives from the driven roller 102, a force 108 is a friction force R3 that the driving roller 101 receives from the driven roller 102, a force 109 is a pressing force P, a force 110 is a force for fixing the driven roller 102 in a horizontal direction, a force 111 is the normal force N3 that the driven roller 102 receives from the driving roller 101, a force 112 is the friction force R3 that the driven roller 102 receives from the driving roller 101, a force 113 is a normal force N2 that the driven roller 102 receives from the recording sheet 103, a force 114 is a friction force R2 that the driven roller 102 receives from the recording sheet 103, a force 115 is the normal force N2 that the recording sheet 103 receives from the driven roller 102, a force 116 is the friction force R2 that the recording sheet 103 receives from the driven roller 102, a force 117 is the normal force N1 that the recording sheet 103 receives from the driving roller 101, a force 118 is the friction force R1 that the recording sheet 103 receives from the driving roller 101, and a force 119 is a conveying force F. The driving roller 101 is fixed horizontally and vertically and is rotatable. The driven roller 102 is fixed horizontally, and is rotatable and vertically movable. The recording sheet 103 is movable horizontally and vertically, where its move in a rotational direction is not considered.

Balance of force referring to FIG. 4 is established as the following Equations (1) to (5).

Balance of force of the driving roller 101 in the rotational direction is expressed by Equation (1):

$$\Delta T = r1 \times (R1 + R3) \tag{1}$$

Balance of force of the driven roller 102 in the rotational direction is expressed by Equation (2):

$$r2 \times R3 = r2 \times R2 \tag{2}$$

Balance of force of the recording sheet 103 in the horizontal direction is expressed by Equation (3):

$$N1 \times \sin\theta 1 + N2 \times \sin\theta 2 = R1 \times \cos\theta 1 + R2 \times \cos\theta 2 + F \tag{3}$$

Balance of force of the recording sheet 103 in the vertical direction is expressed by Equation (4):

$$N1 \times \cos\theta 1 + R1 \times \sin\theta 1 = N2 \times \cos\theta 2 + R2 \times \sin\theta 2 \tag{4}$$

Balance of force of the driven roller 102 in the vertical direction is expressed by Equation (5):

$$P = N2 \times \cos\theta 2 + R2 \times \sin\theta 2 + N3 \tag{5}$$

where, ΔT is torque of the driving roller 101, r1 is a radius of the driving roller 101, r2 is a radius of the driven roller 102, and θ1 and θ2 are curvatures of the driving roller 101 and the driven roller 102 when nipping the recording sheet 103 respectively.

The torque ΔT required for moving the recording sheet 103 forward in a state that the driven roller 102 is pressed down is calculated as follows. At this moment, the driving roller 101 and the driven roller 102 separate, thus Equation (6) is satisfied:

$$N3 = 0, R3 = 0 \tag{6}$$

The following Equation (7) is derived from Equations (1) to (6):

$$\Delta T = P \times r1 \times \sin(\theta 1 + \theta 2)/\cos\theta 2 - F \times r1 \times \cos\theta 1 \tag{7}$$

The curvatures θ1 and θ2 are expressed by the following Equations (8) and (9):

$$\cos\theta 1 = 1 - (d/(r1 + r2)) \times (r2/r1) \tag{8}$$

$$\cos\theta 2 = 1 - (d/(r1 + r2)) \times (r1/r2) \tag{9}$$

where, d is thickness of the recording sheet 103.

The torque ΔT expressed by Equation (7) is a load torque generated when the recording sheet 103 is nipped. If a forward pressing force by the recording sheet 103 is smaller than the pressing force P by the driven roller 102, the load torque is a function of the pressing force P, the radius r1 of the driving roller 101, the radius r2 of the driven roller 102, and the thickness of the recording sheet 103, out of which the factors that contribute the most to the load torque are the pressing force P and the radius r1, so that it is sufficient that the pressing force P and the radius r1 of the driving roller 101 of each of the upstream rollers and the downstream rollers are taken into account. If the radius r2 of the driven roller 102 is significantly larger than the radius r1 of the driving roller 101 for the sake of design, it is expected that an influence by the radius r2 of the driven roller 102 cannot be neglected. If so, Equations (8) and (9) can be used for the calculations. If the forward pressing force by the recording sheet 103 can not be neglected, for example, the forward pressing force by the recording sheet 103 that is being conveyed can be pre-measured by applying a force gauge to a leading edge of the recording sheet 103, and a sheet nipping torque can be calculated in accordance with Equation (7).

Conversion of time frame of the load torque is also required. The time frame of the load torque is the time from nipping the leading edge of the recording sheet 103 to pressing the driven roller 102 down completely, thus the distance (from a point at which the recording sheet 103 is nipped to a point at which the driven roller 102 is completely pressed down) is given by r1×sin θ1. Therefore, r1×sin θ1 for the upstream rollers 1 and the downstream rollers 2 are taken into account. The distance given by r1×sin θ1 is based on a consideration of static balance only. If a higher accuracy is required, dynamic effects are considered, and, for example, experiments and numerical calculations can be employed.

Figure 5:
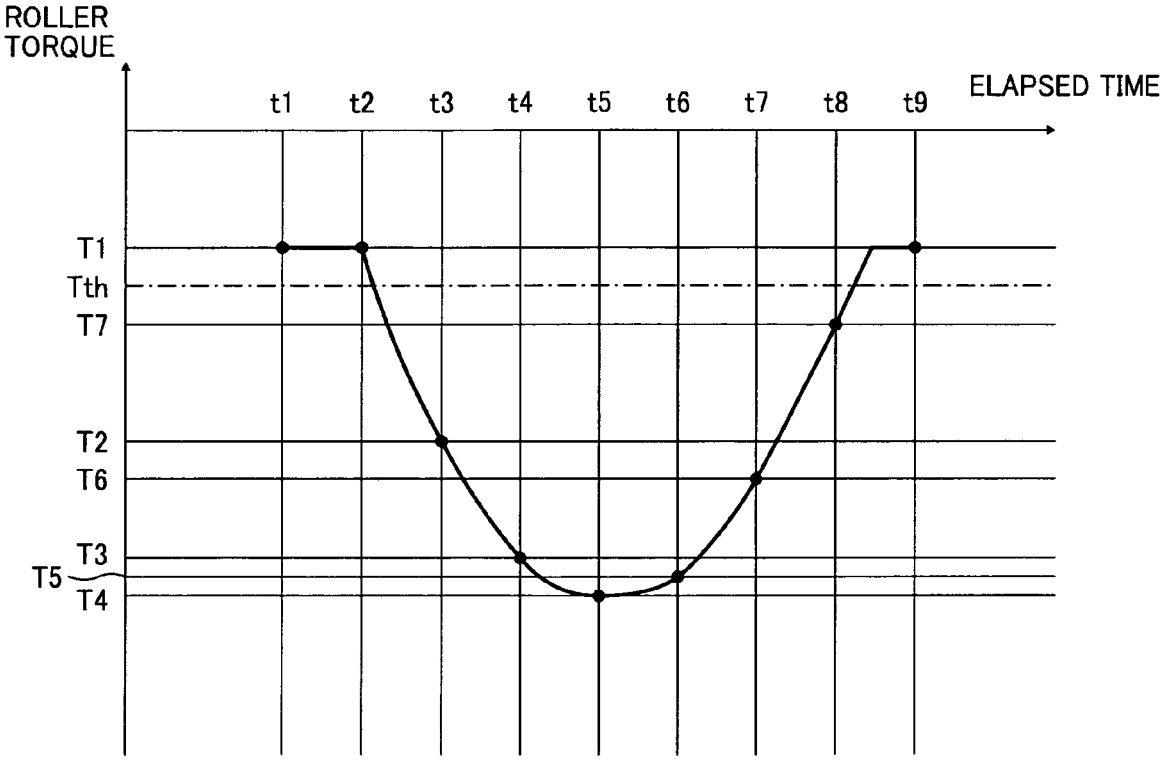
FIG. 5 is a graph and a table for explaining a method for obtaining torque fluctuation data for a pair of upstream rollers shown in FIG. 1.

FIG. 5 is a graph and a table for explaining a method for obtaining torque fluctuation data for the upstream rollers 1. The vertical axis is a roller torque that the driving roller 1*a* receives and the horizontal axis is time. T1 is a roller torque value that the driving roller 1*a* receives in a steady state, and speed is measured in a predetermined cycle tc. The roller torque values of the driving roller 1*a* that are recorded for every predetermined elapsed time are shown in the table of FIG. 5.

While measuring the roller torque values, only the torque data below a preset threshold Tth is stored in the storing unit 13. In a case of FIG. 5, the roller torque values T2, T3, T4, T5, T6, and T7 for a time frame from t3 to t8 are stored in the storing unit 13. The shorter the cycle tc is, the higher accuracy can be obtained for the torque data, which however leads to increase in storing data volume. If, for example, linear velocity of the driving roller 1*a* is 20 mm/sec, the torque fluctuation for an actual driving roller occurs in a time frame of a few milliseconds to over ten milliseconds. Therefore, if the cycle of tc=1 millisecond is used for measuring speed, several to over ten roller torque values can be obtained. The cycle tc can be changed depending upon the rotational speed of the roller.

The torque data stored in the storing unit 13 is converted into a control target value by the calculating unit 14.

The conversion procedure is explained referring to FIGS. 6 to 10.

Figure 6:
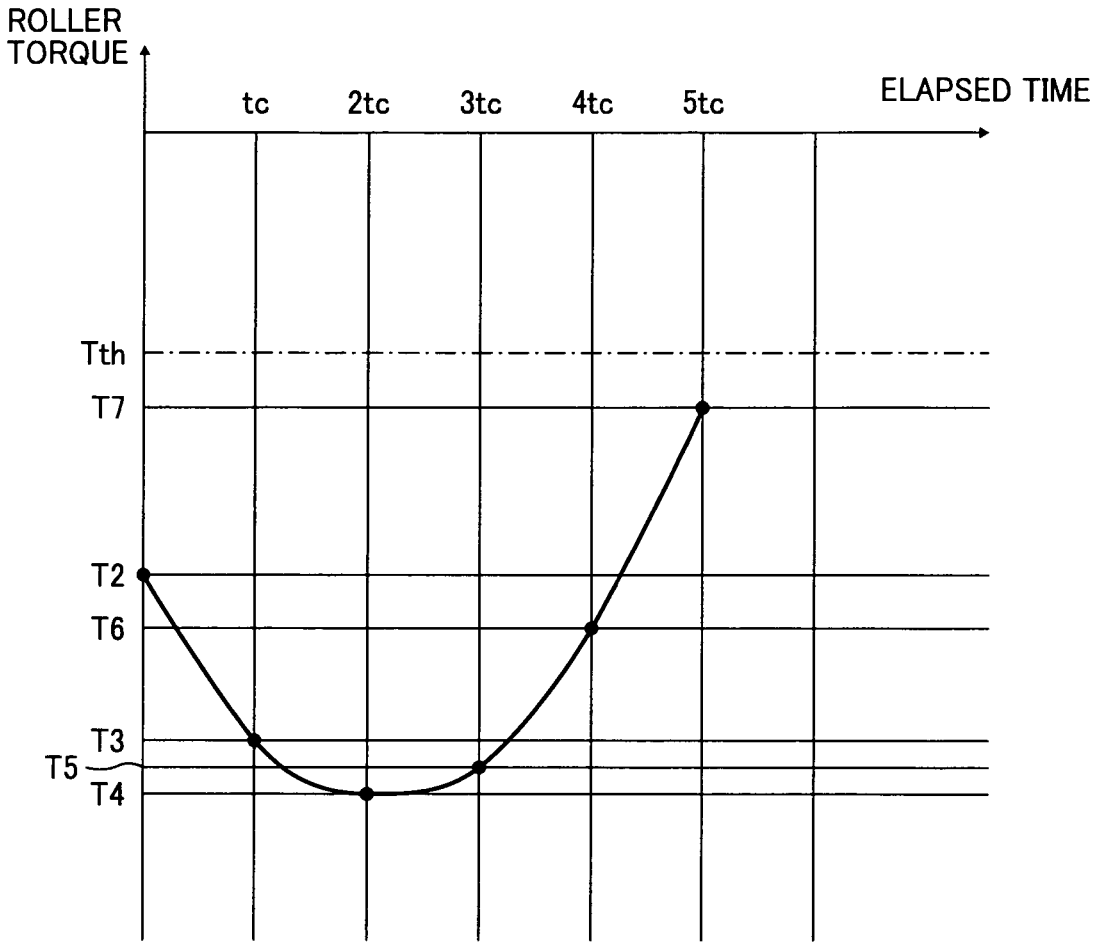
FIG. 6 is a graph and a table for explaining storing data as a process for converting the obtained torque fluctuation data into a control target value.
Figure 7:
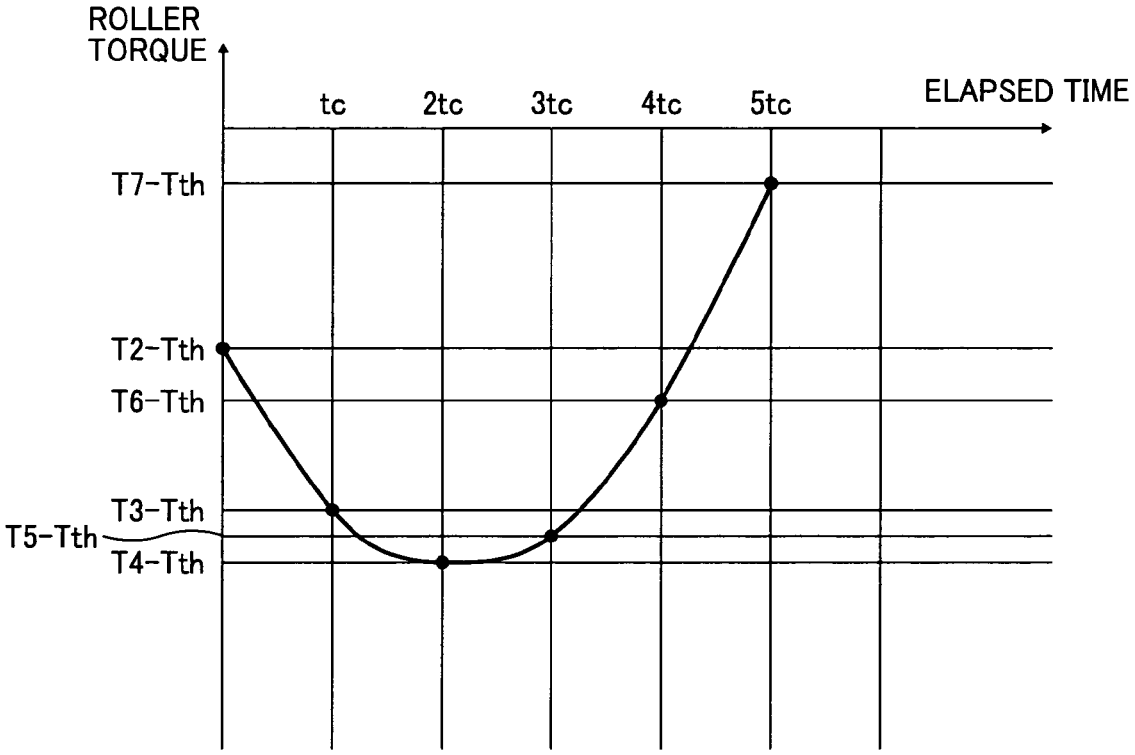
FIG. 7 is a graph and a table for explaining subtracting a threshold value as a process for converting the obtained torque fluctuation data into the control target value.
Figure 8:
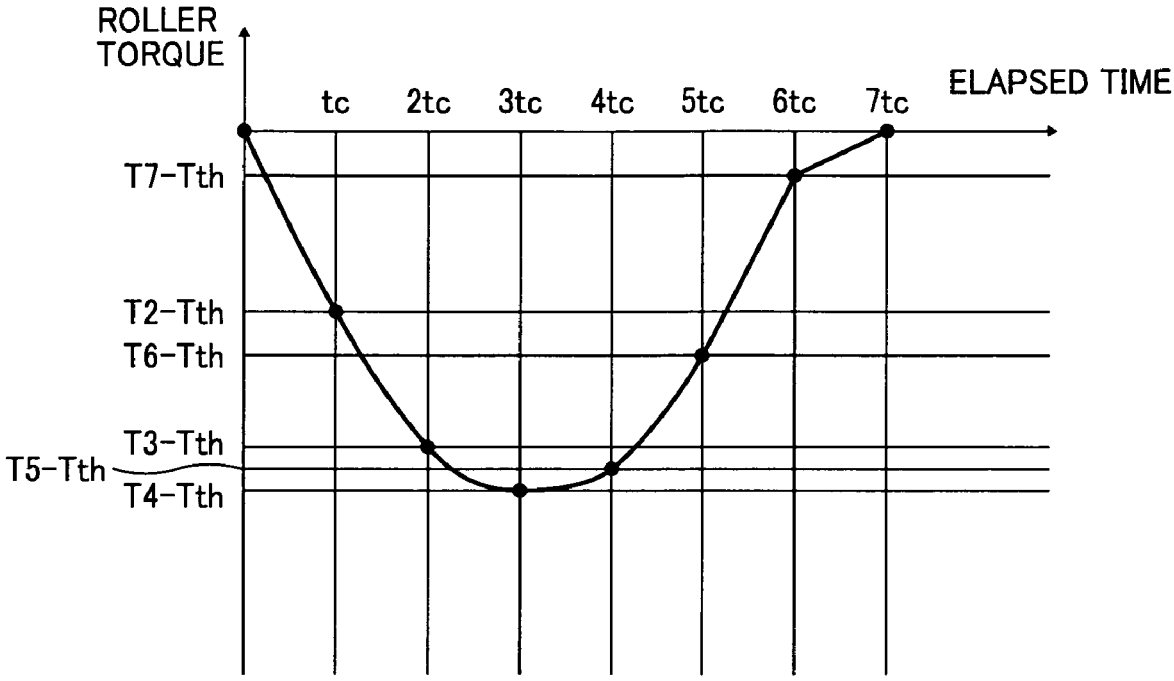
FIG. 8 is a graph and a table for explaining converting data as a process for converting the obtained torque fluctuation data into the control target value.
Figure 9:
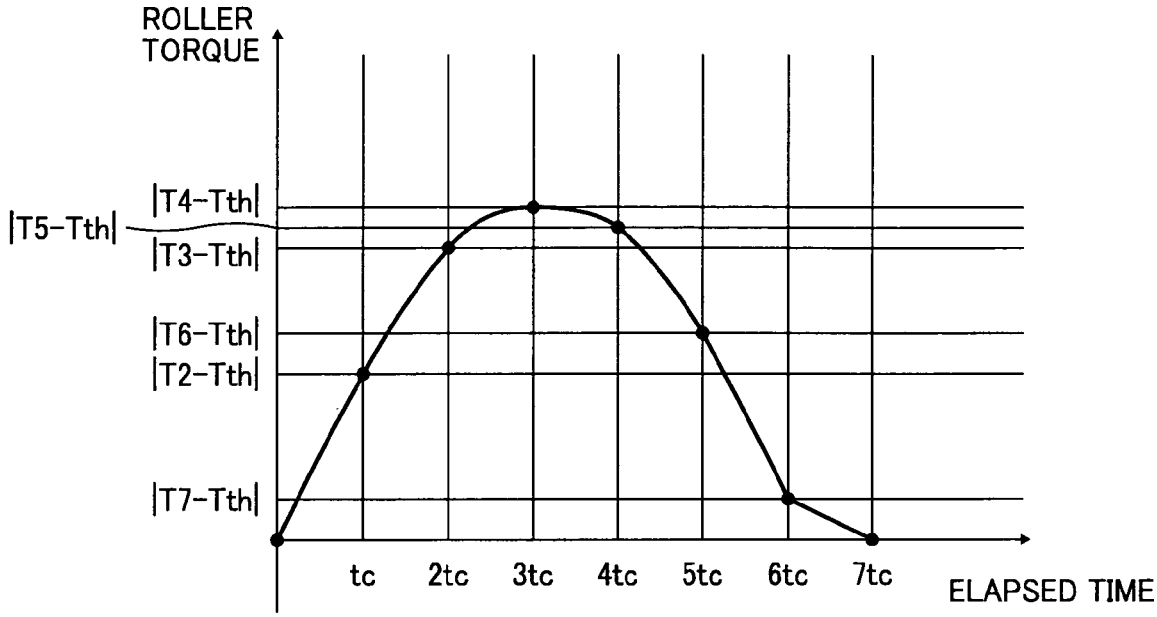
FIG. 9 is a graph and a table for explaining inverting a sign of the values as a process for converting the obtained torque fluctuation data into the control target value.
Figure 10:
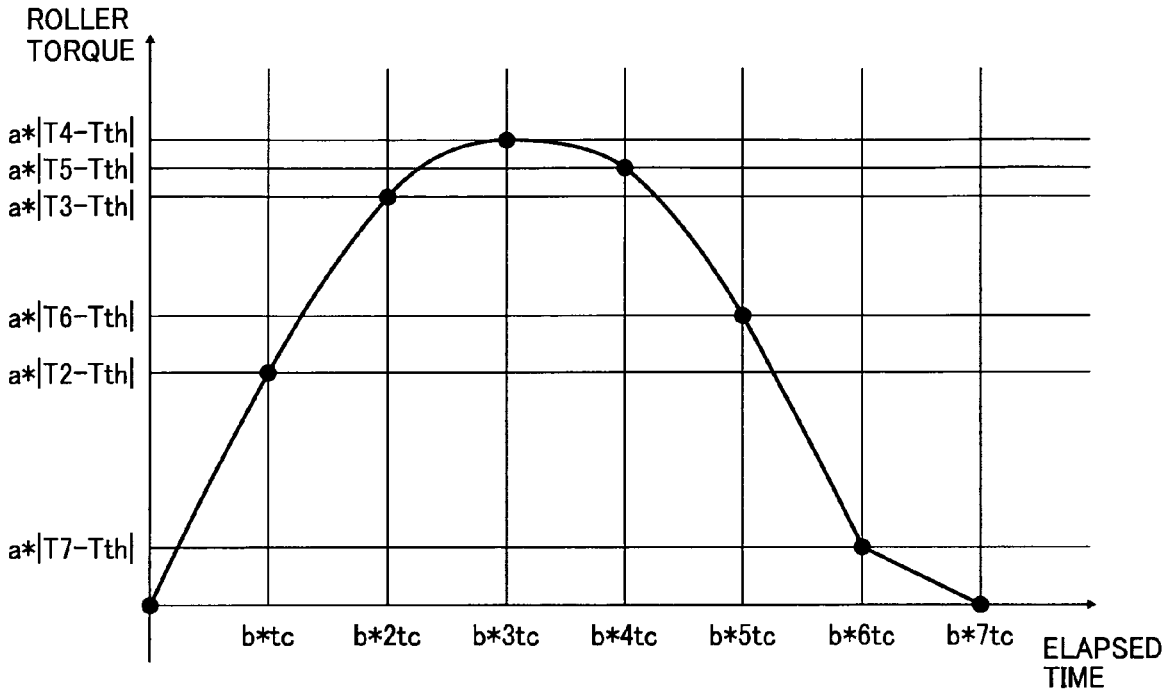
FIG. 10 is a graph and a table for explaining generating a control target value as a process for converting the obtained torque fluctuation data into the control target value.

To eliminate threshold (offset) values in a steady state, the threshold Tth is subtracted from the stored roller torque values T2 to T7 (see FIGS. 6 and 7). Then, zero is applied to the roller torque value before and after the range of the stored roller torque values T2 to T7 (FIG. 8). Then, the roller torque values in the table of FIG. 8 are multiplied by −1 for inverting a sign of the values (see FIG. 9).

The time value table of the sign inverted roller torque waveform is multiplied by "b", and the torque value table of the sign inverted roller torque is multiplied by "a", to generate a torque control target value (see FIG. 10) at the time of nipping the sheet S on the downstream side. "a" is a torque data conversion coefficient from upstream side to downstream side and "b" is a time data conversion coefficient from upstream side to downstream side, and "a" and "b" are given by $$a=(P''\times r1)/(P'\times r1')$$

$$b=(r1''\times\sin\theta1'')/(r1'\times\sin\theta1')$$

where P' is pressing force of the upstream rollers 1, r1' is a radius of the driving roller 1*a*, θ1' is a curvature of the driving roller 1*a*, P" is pressing force of the downstream rollers 2, r1" is a radius of the driving roller 2*a*, and θ1" is a curvature of the driving roller 2*a*.

The torque control target value obtained by the calculating unit 14 is sent to the feedforward controller 22.

The feedforward controller 22 converts the torque control target value into a current control target value. Division by torque constant of the driving source 15 and by reduction ratio from a motor to a roller can be used for the conversion.

In this manner, the current control command value is obtained by the feedforward controller 22, with which toque control of the driving roller 2*a* is performed.

According to the first embodiment, based on the torque fluctuation of the upstream rollers 1 (see FIG. 6), the torque control target value (see FIG. 10) for the downstream rollers 2 can be calculated in real time.

If successive uses of the same type of the sheets are predicted when calculating a control target value, it is preferable to add a setting function to enable repeated use of the control target value calculated for the first sheet for the rest of the sheets. When such a setting function is selected, repetition of performing the same process can be omitted, thereby enabling suppression of wasteful power consumption. For example, a selector switch or a mode selector can be arranged for switching between target value calculation for every time or target value calculation for one time for a plurality of sheets.

Generation of the torque control target value from the torque of the upstream rollers 1 at the time of nipping the sheet S enables appropriate controlling of the downstream rollers 2, thereby suppressing the speed fluctuation of the downstream rollers 2 regardless of the thickness and the type of the sheets, or the operating environment. With the use of the sheet conveying device according to the first embodiment, the speed fluctuation in a pair of rollers by entry of a thick sheet into the rollers can be suppressed, whereby the speed of the rollers (control target) can always be kept constant.

Furthermore, a sensor for measuring the thickness of sheets is not necessary, so that cost increase can be suppressed. Moreover, the speed fluctuation in units that convey sheets can be effectively prevented regardless of the type of the sheets or the operating environment.

A second embodiment of a sheet conveying device according to the present invention is explained below.

In the second embodiment, the torque at the time that the upstream rollers 1 nip the sheet S is not measured. Although a motor of any type described above can be employed for the driving source 5 in the first embodiment, the DC motor is used as the driving source 5 and a load torque at the time of nipping the sheet S is calculated from a driving current of the DC motor in the second embodiment.

Specifically, a current value of the DC motor at the time of nipping the sheet S is recorded. The recorded current value is multiplied by torque constant of the DC motor and by reduction ratio from the motor to the driving roller 1*a* with reference to a current value table that is prepared in advance to calculate the load torque at the time that the upstream rollers 1 nip the sheet S. The current value table explains a relationship between current and torque. The torque of the downstream rollers 2 when nipping the sheet S can be set in the same manner as the first embodiment.

An image forming apparatus including the sheet conveying device according to the above embodiments is explained below.

The technique according to the above embodiments is beneficial to all kinds of sheet conveying units. Especially, the effects by the present invention can be most advantageously seen in an electrophotographic image forming apparatus that includes a sheet conveying device. The sheet conveying unit is applied to a registration unit, an intermediate transfer unit, and a fixing unit in the image forming apparatus. Wide variety of constructions and methods are available for the image forming apparatus. As a typical example, a tandem-type image forming apparatus employing an intermediate transfer method to which the present invention is applied is explained below.

Figure 11:
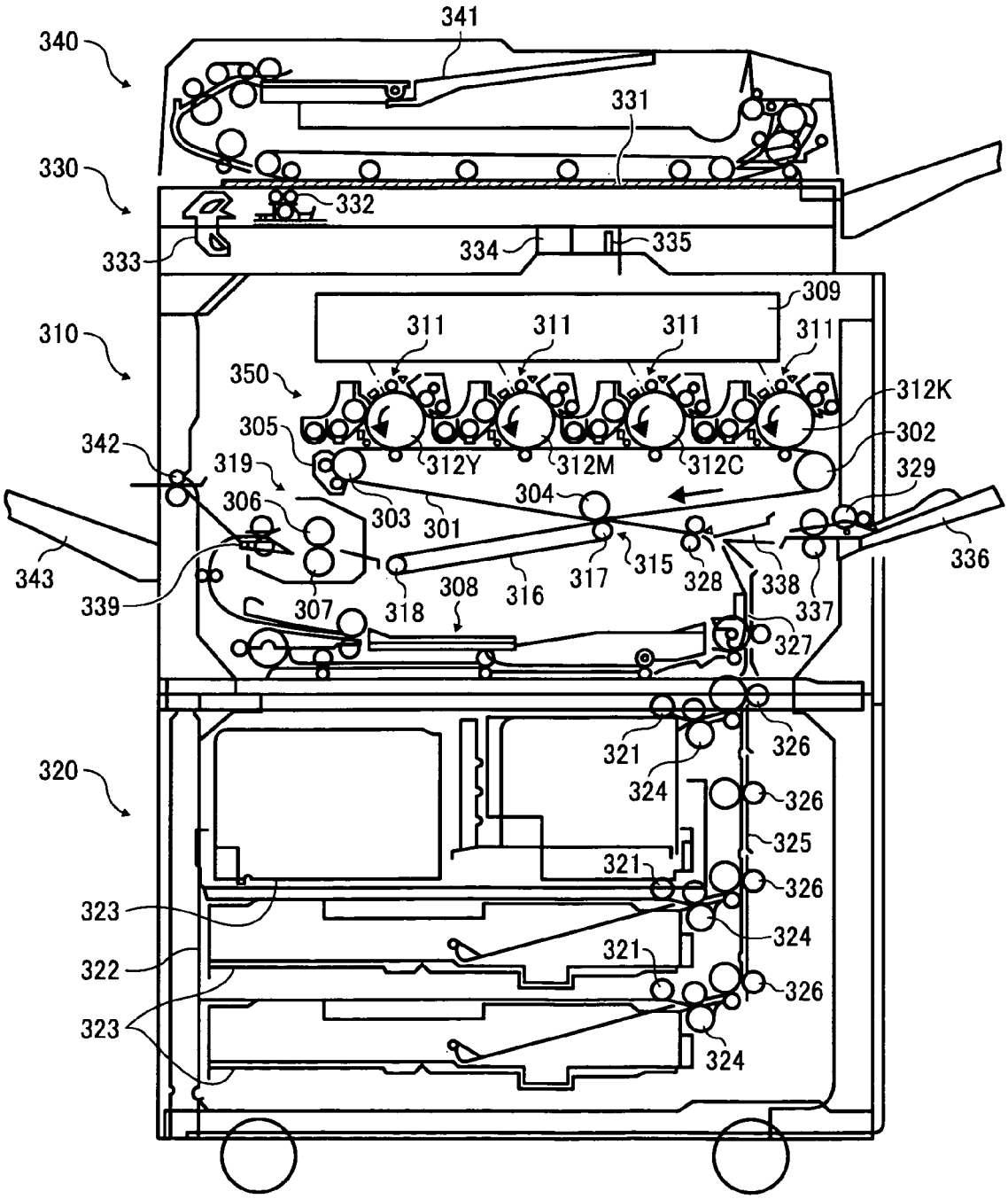
FIG. 11 is a schematic diagram of a copier as an example of an image forming apparatus to which the present invention is applied.

The image forming apparatus shown in FIG. 11 is a tandem-type full-color electrophotographic apparatus that employs the intermediate transfer system and includes an image reading unit to be configured as a copier. The image forming apparatus includes a feed tray 320, a main unit 310, a scanner 330, and an auto document feeder (ADF) 340, which are arranged in this sequence from bottom to up.

An endless intermediate transfer belt 301 as an intermediate transfer unit is arranged in a substantially center portion of the main unit 310. The intermediate transfer belt 301 is supported with a first support roller 302, a second support roller 303, and a third support roller 304 in FIG. 11. The intermediate transfer belt 301 is rotatably movable in a clockwise direction in FIG. 11 (which is hereinafter simply taken as "motion" when viewed partially). An intermediate-transfer-belt cleaning unit 305 that cleans residual toner remaining on the intermediate transfer belt 301 after transfer processing is arranged on the left side of the second support roller 303.

Above the intermediate transfer belt 301 supported with the first support roller 302 and the second support roller 303, a tandem image forming unit 350 is arranged. The tandem image forming unit 350 is configured with four different-color image forming units 311 of yellow (Y), magenta (M), cyan (C), and black (B) that are lined up laterally along a moving direction of the intermediate transfer belt 301. The third support roller 304 serves as a driving roller. Above the tandem image forming unit 350, an exposure unit 309 is arranged.

The belt-type intermediate-transfer image forming apparatus is employed as the image forming apparatus; however, a drum-type intermediate-transfer image forming apparatus can be employed. In a case of the drum-type, the first, the second, and the third support rollers 302, 303, and 304 are not necessary, and the image forming units 311 are arranged around and along the intermediate transfer drum, and are not laterally lined up. The present invention is applicable to an intermediate transfer unit regardless of the belt type or the drum type.

The main unit 310 includes a secondary-transfer unit 315 on an opposite side of the tandem image forming unit 350 relative to the intermediate transfer belt 301. The secondary-transfer unit 315 includes two belt-support rollers 317 and 318 that support an endless secondary-transfer belt 316. The belt-support roller 317 presses the third support roller 304 through the intermediate transfer belt 301 to form a nip portion, so that an image formed on the intermediate transfer belt 301 is transferred onto a sheet when the sheet passes the nip portion. A fixing unit 319 that fixes the image that is transferred onto the sheet S to the sheet S is arranged next to the secondary-transfer unit 315. The secondary-transfer unit 315 also serves as a sheet conveying unit that conveys the sheet S on which the image is transferred to the fixing unit 319. Alternatively for the secondary-transfer unit 315, a transfer roller or a non-contact charger can be arranged. In such a case, a conveying unit for conveying a sheet from a secondary-transfer unit to a fixing unit needs to be additionally arranged.

The fixing unit 319 includes a fixing roller 306 and a pressure roller 307 that is in pressure contact with the fixing roller 306. The fixing roller 306 includes a heat generation mechanism internally to heat up to a temperature needed for fixing an unfixed image to a sheet. The unfixed image on the sheet S is heated and pressed to be fixed onto the sheet. Alternatively, a belt-type fixing unit can be employed as the fixing unit 319. Namely, the present invention is applicable to a fixing unit regardless of the roller-fixing method or the belt-fixing method.

In FIG. 11, a sheet inverting unit 308 that inverts a sheet for forming images on both sides of the sheet is arranged under the secondary-transfer unit 315 and the fixing unit 319 in parallel to the tandem image forming unit 350.

For copying using the electrophotographic image forming apparatus, an original is set on an original tray 341 of the ADF 340, or the original is set on an exposure glass 331 of the scanner 330 by opening the ADF 340 and the original is covered by closing the ADF 340.

The reading process is explained. When the original is set on the ADF 340 and a start button (not shown) is pressed, the original is moved to the exposure glass 331. By contrast, when the original is set on the exposure glass 331 and the start button is pressed, the scanner 330 is driven to operate immediately, and a first scanning unit 332 and a second scanning unit 333 operate. Light is emitted from a light source in the first scanning unit 332, which is reflected by a surface of the original. Then, the light is reflected toward the second scanning unit 333, and is further reflected by a mirror of the second scanning unit 333 to be read by a reading sensor 335 through an imaging lens 334, so that the original is read.

In parallel to the reading process of the original, a color-image forming process is performed. The third support roller 304 is driven to rotate by a driving motor (not shown) to subsequently rotate the first and second support rollers 302 and 303, so that the intermediate transfer belt 301 is driven to rotate. Concurrently, a photosensitive element 312 of each of the image forming units 311 is rotated to expose and develop a corresponding color image based on color data of a corresponding one of yellow, magenta, cyan, and black on the photosensitive element 312. Each of the developed four color toner images is sequentially transferred onto the intermediate transfer belt 301 as the movement of the intermediate transfer belt 301 to form a full-color toner image.

In parallel to the image forming process, a sheet feeding process is performed. For example, one of feed rollers 321 in the feed tray 320 is selected to be rotated, and sheets are picked up from one of multiple-stage feed cassettes 323 in a paper bank 322 such that the sheets are separated one by one by a separation roller 324. The separated sheet is fed to a feed path 325, guided into a feed path in the main unit 310 by a conveying roller 326, and stopped by bringing the sheet into contact with a pair of registration rollers 328. In a case of using a manual feed tray 336, a feed roller 329 is rotated to feed the sheets on the manual feed tray 336 to be separated one by one by a separation roller 337. The separated sheet is fed to a manual feed path 338 and stopped by also reaching the registration rollers 328.

The registration rollers 328 are rotated to feed the sheet to a nip portion between the intermediate transfer belt 301 and the secondary-transfer unit 315 in synchronization with the timing of the full-color toner image on the intermediate transfer belt 301, so that the full-color toner image is transferred onto the sheet at the secondary-transfer unit 315.

The image-transferred sheet is fed to the fixing unit 319 by the secondary-transfer belt 316, at which heat and pressure are applied, so that the transferred full-color toner image is fixed to the sheet. Thereafter, the feed path of the sheets is switched by switching a claw 339 such that the sheets are discharged by a discharge roller 342 to be stacked on a catch tray 343. For both-side image formation, the sheet is fed into the sheet inverting unit 308 by switching the claw 339 to be inverted and guided into the image transfer position again, and an image is formed on the backside of the sheet. Then, the sheet is discharged to the catch tray 343 by the discharge roller 342.

Residual toner remaining on the post-transferred intermediate transfer belt 301 is cleaned by the intermediate-transfer-belt cleaning unit 305 to be ready for the next image forming process by the tandem image forming unit 350. The registration rollers 328 are generally grounded; however, a bias voltage can be applied to the registration rollers 328 to remove toner powder on the sheet.

This electrophotographic image forming apparatus can be also used for performing black-and-white copying. In this case, photosensitive elements 312Y, 312C, and 312M are separated away from the intermediate transfer belt 301 by a unit (not shown). The photosensitive elements 312Y, 312C, and 312M are stopped temporarily, and only a photosensitive element 312K is in contact with the intermediate transfer belt 301 to form and transfer a black-and-white image.

In the present example, the registration unit (registration rollers 328) serves as the upstream conveying unit and a secondary-transfer unit (third support roller 304 and belt-support roller 317) serves as the downstream conveying unit. A torque at the time that the registration rollers 328 nip the sheet S is measured (corresponding to the sheet conveying device according to the first embodiment) or the torque is estimated (corresponding to the sheet conveying device according to the second embodiment). Based on the toque data, a torque at the time that the third support roller 304 and the belt-support roller 317 on the downstream side nip the sheet S is calculated or estimated, and a torque for counterbalancing a load torque at the time that the third support roller 304 and the belt-support roller 317 nip the sheet S is applied thereto in synchronization with the timing of entry of the sheet S into the secondary-transfer unit. When torque measurement is performed on the registration rollers 328, a torque measuring unit is arranged on a driving roller as explained in the first embodiment.

Figure 12:
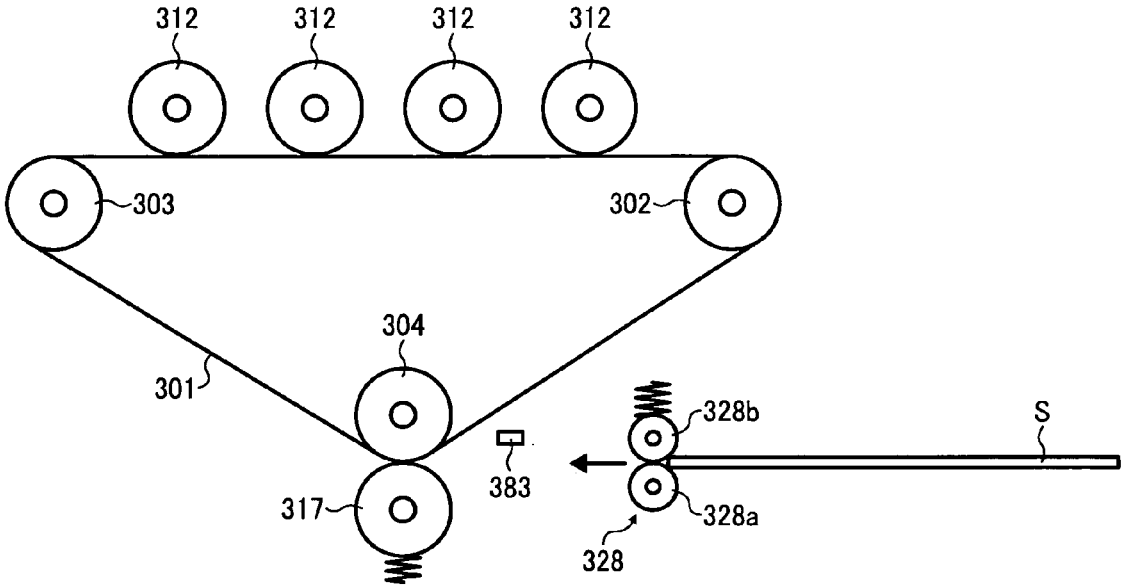
FIG. 12 is a schematic diagram for explaining an example in which the present invention is applied to a registration unit and a secondary-transfer unit shown in FIG. 11.

FIG. 12 is a schematic diagram of the registration unit and the second transfer unit of the image forming apparatus shown in FIG. 11. In this construction, the registration rollers 328 correspond to the upstream rollers 1, and the third support roller 304 and the belt-support roller 317 correspond to the downstream rollers 2.

In the present example, it is necessary to arrange a torque measuring unit on the registration rollers 328 or to measure a driving current of a DC motor (corresponding to the driving source 5) that drives the registration rollers 328. In addition, a DC motor is required for a driving source for the second transfer unit because it is the driving motor that imposes the estimated torque to the second transfer unit on the downstream side.

In the present example, a sheet nipping torque at the second transfer unit is estimated based on the sheet nipping torque at the registration rollers 328. Note that the registration rollers 328 nip the sheet S in a stationary state whereas the second transfer unit nips the sheet S that is being conveyed. In such a case, a sheet nipping torque at the second transfer unit can be estimated by subtracting the forward pressing force by the sheet S after completing conversions using coefficients of roller diameter and pressing force at the registration rollers 328 and at the secondary-transfer unit 315. Other processes are the same as the above explanation.

As the sheet-entry-detecting unit that estimates entry of the sheet S into the second transfer unit, a sheet detecting sensor 383 is arranged between the registration rollers 328 and the second transfer unit. The timing of the entry of the sheet S into the second transfer unit is estimated based on a detection signal from the sheet detecting sensor 383. If such a sheet detecting sensor is not used, for example, an operation start signal of the registration rollers 328 can be employed. Calculation of a counterbalancing torque to be applied to the second transfer unit is as explained above.

In this manner, estimating the sheet nipping torque at the second transfer unit from the sheet nipping torque at the registration rollers 328 and applying the torque to the second transfer unit in synchronization with the timing of nipping the sheet S at the second transfer unit enables counterbalancing the sheet nipping torque at the second transfer unit, resulting in suppression of the speed fluctuation when the sheet S enters into the second transfer unit. This can prevent positional shift between the intermediate transfer belt 301 and each of the photosensitive elements 312 serving as the primary transfer unit, leading to improvement in image quality. If this control is applied only to thicker sheets than a predetermined thickness in a correlation with image quality, load on a control unit can be reduced. For example, a selectable mode for thick sheets by such as an operation panel or by controlling with an external device such as a personal computer (PC) connected to the image forming apparatus can be employed to apply a counterbalancing torque only when the mode for thick sheets is selected.

As another example of applying the above embodiments to the image forming apparatus shown in FIG. 11, the secondary-transfer unit serves as the upstream conveying unit and the fixing unit 319 serves as the downstream conveying unit.

Figure 13:
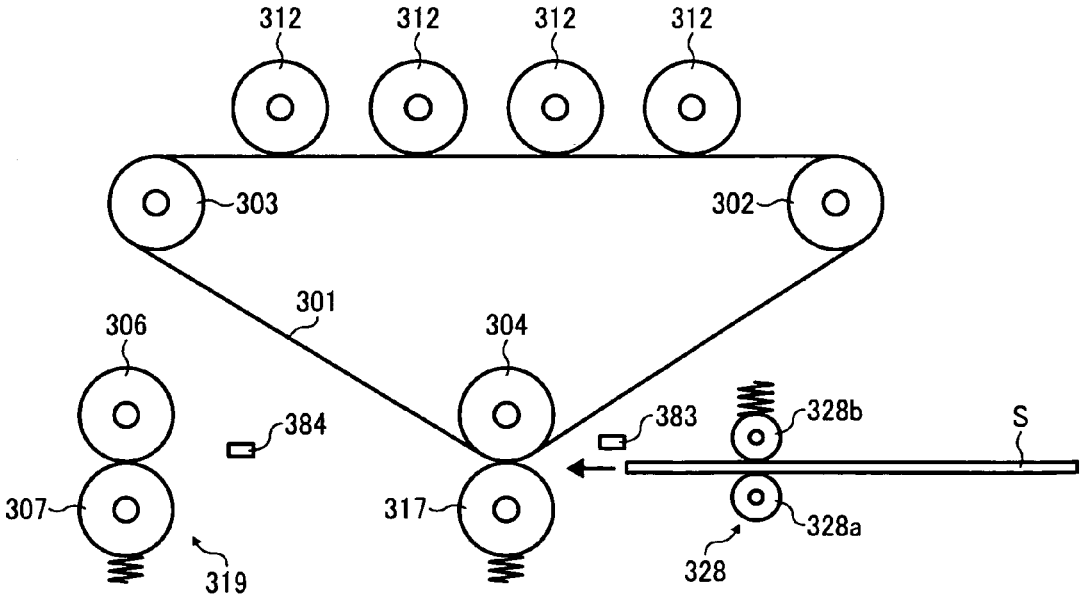
FIG. 13 is a schematic diagram for explaining an example in which the present invention is applied to the secondary-transfer unit and a fixing unit shown in FIG. 11.

FIG. 13 is a schematic diagram of the primary-transfer unit, the secondary-transfer unit, and the fixing unit 319. In this construction, the third support roller 304 and the belt-support roller 317 that constitute the secondary-transfer unit correspond to the upstream rollers 1, and the fixing unit 319 corresponds to the downstream rollers 2.

In this example, it is necessary to arrange a torque measuring unit on the third support roller 304 or to use a DC motor (corresponding to the driving source 5) that drives the intermediate transfer belt 301 and measure a driving current of the DC motor. In addition, a DC motor is required for a driving source for the fixing unit 319 (downstream conveying unit) because it is the driving motor that imposes the estimated torque to the fixing unit 319 on the downstream side.

Furthermore, a sheet nipping torque at the fixing unit 319 is estimated from the sheet nipping torque at the secondary-transfer unit. The estimation of the sheet nipping torque at the fixing unit 319 is given using coefficients of roller diameter and pressing force at the secondary-transfer unit and at the fixing unit 319. If the forward pressing force by the sheet S cannot be neglected in connection with the pressing force by rollers, the estimated torque can be subtracted by the forward pressing force by the sheet S in accordance with Equation (7), which is converted into a torque control target value by calculating with coefficients "a" and "b".

As the sheet-entry-detecting unit that estimates entry of the sheet S into the fixing unit 319, a sheet detecting sensor 384 is arranged between the secondary-transfer unit and the fixing unit 319. The timing of entering the sheet S into the fixing unit 319 can be estimated based on a detection signal from the sheet detecting sensor 384. Alternatively, for example, an operation start signal of the registration rollers 328 can be used if such a sheet detecting sensor is not used.

Similarly to the above example, the sheet nipping torque at the secondary-transfer unit is measured or estimated, and the sheet nipping torque at the fixing unit 319 is calculated based on the measured torque or the estimated torque to apply a counterbalancing torque in synchronization with the timing that the fixing unit 319 nips the sheet S.

In this manner, the speed fluctuation, when the sheet S enters into the fixing unit 319, can be suppressed by estimating the sheet nipping torque at the fixing unit 319 based on the sheet nipping torque at the secondary-transfer unit, and applying the counterbalancing torque in synchronization with the timing that the fixing unit 319 nips the sheet S. This sheet nipping torque control also can prevent uneven lubrication on the fixing roller 306, leading to improvement in image quality. If the nipping toque control is applied only to thicker sheets than a predetermined thickness in a correlation with image quality, load on a control unit can be reduced. For example, a selectable mode for thick sheets by such as an operation panel or by an external device such as a PC connected to the image forming apparatus can be employed to apply a counterbalancing torque only when the mode for thick sheets is selected.

The sheet conveying device according to the present invention can be employed to a concurrent transferring/fixing image forming apparatus.

Figure 14:
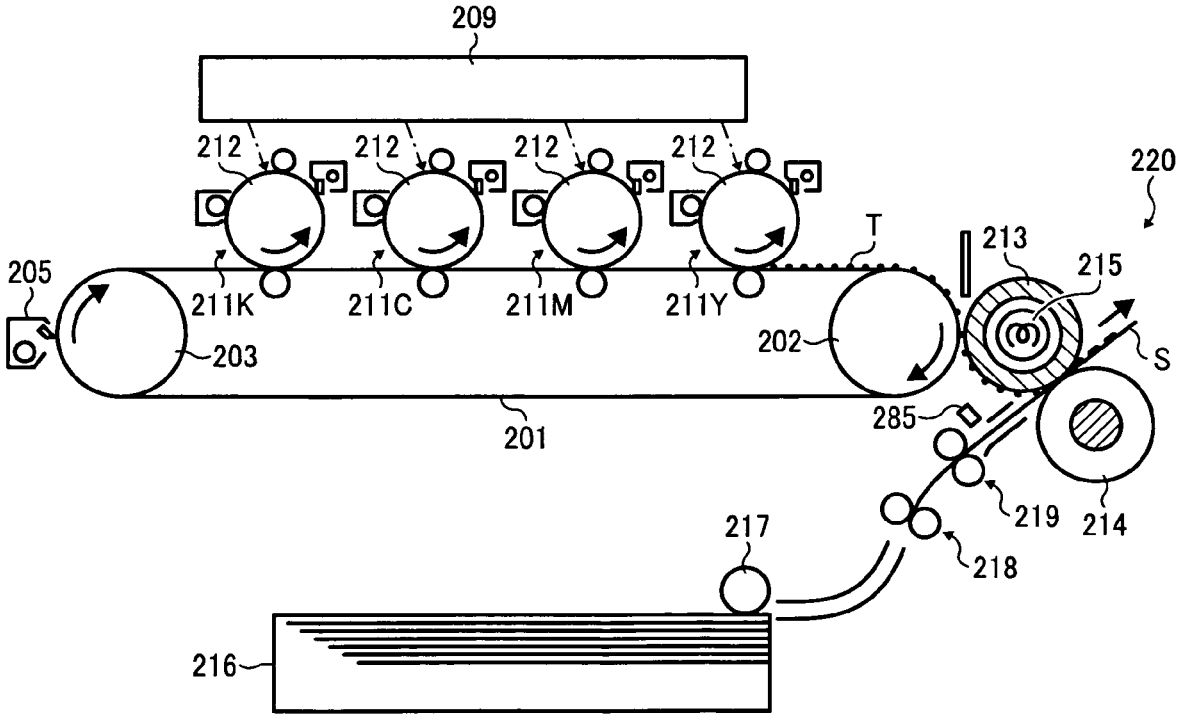
FIG. 14 is a schematic diagram of a relevant portion of a concurrent transferring/fixing image forming apparatus to which the present invention is applied.
Figure 15:
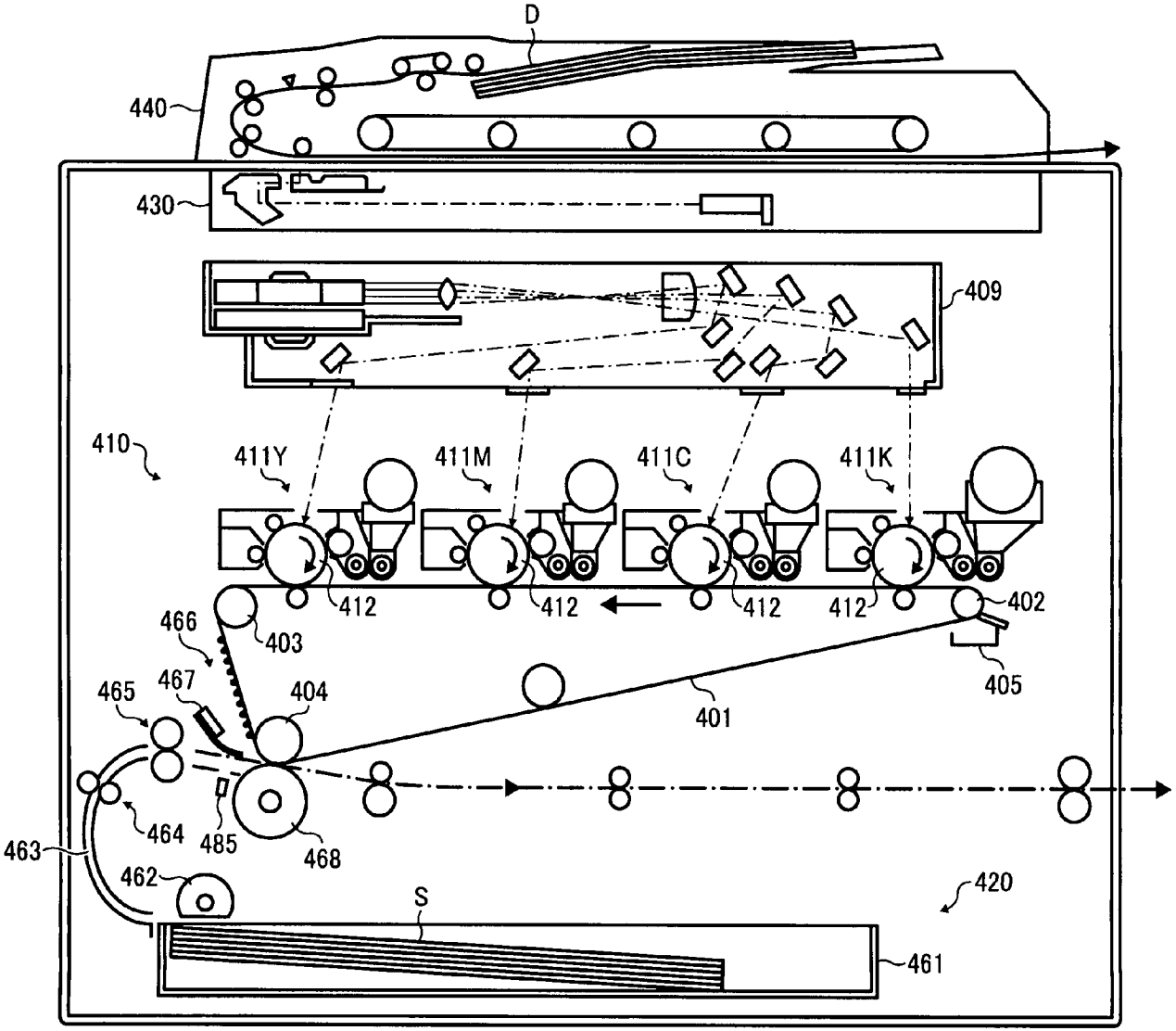
FIG. 15 is a schematic diagram of another concurrent transferring/fixing image forming apparatus to which the present invention is applied.

FIGS. 14 and 15 explain a tandem intermediate-transfer-type image forming apparatus that is the same type as that shown in FIG. 11. The difference is that this image forming apparatus employs a transferring/fixing method that concurrently performs transferring and fixing an image onto a sheet.

FIG. 14 is a schematic diagram of a concurrent transferring/fixing unit 220 and a relevant portion of the transferring/fixing unit 220 of the tandem intermediate-transfer-type image forming apparatus. The basic construction of an image forming unit and operation for forming image in the electrophotographic process are similar to those shown in FIG. 11, so that the following explanations are focused on differences.

As shown in FIG. 14, a transferring/fixing roller 213 (second intermediate transfer unit) is arranged opposed to a support roller 202 for an intermediate transfer belt 201 through the intermediate transfer belt 201. The transferring/fixing roller 213 includes a heater 215 internally that functions as a heating unit, and a pressure roller 214 is arranged to be in pressure contact with the transferring/fixing roller 213. In this example, the transferring/fixing unit 220 is configured with the transferring/fixing roller 213 and the pressure roller 214.

Sheets that are accommodated in a feed tray 216 are fed to a feed path by a feed unit 217, subsequently fed to conveying rollers 218 arranged on the feed path, and fed to the transferring/fixing unit 220 by a pair of registration rollers 219.

A toner image T carried on the intermediate transfer belt 201 is secondary transferred onto the transferring/fixing roller 213 to be melted on the transferring/fixing roller 213 with heat by the heater 215, pressed at a nip portion formed between the transferring/fixing roller 213 and the pressure roller 214, and transferred and fixed onto the sheet S.

The second intermediate transfer unit is not limited to the roller type as shown in FIG. 14. Alternatively, a belt type can be employed. In addition, a halogen heater, a ceramic heater, an induction heater, or the like can optionally be used for the heating unit. The heating method or mode is not limited, and the pressing method or mode is not limited either.

The toner image T that is transferred onto the transferring/fixing roller 213 from the intermediate transfer belt 201 is heated on the transferring/fixing roller 213 until the toner image T is fixed onto the sheet S at the nip portion. This allows sufficient preheating of the toner, so that the heating temperature can be lower than a typical heating method of concurrent heating of toner and a sheet. As a result of an experiment, it is confirmed that sufficient image quality is obtainable with low temperatures from 110° C. to 120° C. for the transferring/fixing roller 213.

A typical color image forming apparatus is provided with 1.5 times heating volume for a black-and-white image forming apparatus to obtain sufficiently glossy finish, taking a temperature drop of a sheet into consideration, resulting in overheating of the sheet and excessive enhancement of adhesion property of the toner to the sheet.

On the other hand, with this configuration, the temperature of the transferring/fixing roller 213 (fixing setting temperature) can be set low, because the temperature for obtaining sufficiently glossy finish is settable without considering the temperature of the sheet S. Furthermore, heating of the sheet S is only performed at the nip portion, so that the sheet S is not overheated and adhesion property of the toner to the sheet S is not overly enhanced. Therefore, low-temperature fixing is attainable, leading to shortening of warm-up time and contributing to energy saving. Moreover, heat transfer to the intermediate transfer unit can be suppressed, so that the lifetime of the intermediate transfer unit can be prolonged. Furthermore, the temperature of the intermediate transfer unit itself can be reduced, leading to prevention of thermal degradation of the intermediate transfer unit.

In this example, the registration rollers 219 serve as the upstream conveying unit and the transferring/fixing unit 220 serves as the downstream conveying unit. In this case, a torque measuring unit needs to be mounted on the registration rollers 219, or the driving current of the DC motor that drives the registration rollers 219 needs to be measured. Furthermore, the estimated torque needs to be applied to the transferring/fixing unit 220, and such is performed by the driving motor, so that the DC motor is needed for the driving source of the transferring/fixing roller 213.

The sheet nipping torque at the transferring/fixing unit 220 is estimated based on the sheet nipping torque at the registration rollers 219. Note that the registration rollers 219 nip the sheet S in a stationary state whereas the transferring/fixing unit 220 nips the sheet S that is being conveyed. In such a case, the sheet nipping torque at the transferring/fixing unit 220 (torque to be imposed on the downstream conveying unit) can be estimated taking the difference in the forward pressing force by the sheet S into account as explained in FIG. 12.

As shown in FIG. 14, as a sheet-entry-detecting unit that estimates entry of the sheet S into the transferring/fixing unit 220, a sheet detecting sensor 285 is arranged between the registration rollers 219 and the transferring/fixing unit 220. The timing of entering the sheet S into the transferring/fixing unit 220 can be estimated based on a detection signal from the sheet detecting sensor 285. If such a sheet detecting sensor is not used, for example, an operation start signal of the registration rollers 219 can be used.

In this manner, the speed fluctuation of entering the sheet S into the transferring/fixing unit 220 can be suppressed by applying the counterbalancing torque in synchronization with the timing of nipping the sheet S at the transferring/fixing unit 220 based on the estimation of the sheet nipping torque at the transferring/fixing unit 220 calculated from the sheet nipping torque at the registration rollers 219. This sheet nipping torque control also can prevent positional shift between the intermediate transfer belt 201 and the transferring/fixing roller 213, leading to improvement in image quality. If this toque control is applied only to thicker sheets than a predetermined thickness in a correlation with image quality, load on a control unit can be reduced. For example, a selectable mode for thick sheets by such as an operation panel or by an external device such as a PC connected to the image forming apparatus can be employed to apply a counterbalancing torque only when the mode for thick sheets is selected.

FIG. 15 schematically explains an image forming apparatus that is configured as a copier same as that shown in FIG. 11. The image forming apparatus includes a feed unit 420 in a lower section of the image forming apparatus, an image forming unit 410 in a vertically center section of the image forming apparatus, a scanner 430, and an ADF 440 in this sequence from bottom to up. The basic construction of the image forming apparatus shown in FIG. 15 is similar to that shown in FIG. 11 except a transferring/fixing unit 466. In addition, the operation of image forming by an electrophotographic process is well known, so that the following explanation is focused on the transferring/fixing unit 466.

In the concurrent transferring/fixing image forming apparatus shown in FIG. 15, one of a plurality of support rollers that supports an intermediate transfer belt 401 is a transferring/fixing roller 404. A pressure roller 468 is arranged in pressure contact with the transferring/fixing roller 404 through the intermediate transfer belt 401, and a sheet heating unit 467 is arranged at a position just upstream of the pressure roller 468 in a sheet conveying direction. The transferring/fixing unit 466 includes the sheet heating unit 467, the transferring/fixing roller 404, and the pressure roller 468. The sheet heating unit 467 is not limited to the plate-like unit as shown in FIG. 15, and a roller-type unit can be employed. Furthermore, the pressure roller 468 is not limited to the roller type, and a pressure pad or a pressure belt can be employed.

For the feed unit 420 located in the lower portion of the image forming apparatus, a feed cassette 461 and a feeder 462 that feeds the sheet S from the feed cassette 461 are arranged. The sheet S fed from the feed cassette 461 is conveyed by a pair of conveying rollers 464 arranged on a feed path 463, and then is conveyed to the transferring/fixing unit 466 by a pair of registration rollers 465.

For the sheet S entered into the transferring/fixing unit 466, the surface of the sheet S is heated to a temperature high enough to melt the toner with the sheet heating unit 467. The heated sheet S is subsequently nipped at the nip portion formed on the intermediate transfer belt 401 by the transferring/fixing roller 404 and the pressure roller 468. Thus, the toner image on the intermediate transfer belt 401 is melted by the heat of the sheet S and is concurrently pressed at the nip portion at the transferring/fixing unit 466 to be transferred and fixed to the sheet S. In this example, the sheet S is heated by the sheet heating unit 467 before entering into the nip portion at the transferring/fixing unit 466, so that the intermediate transfer belt 401 (transferring/fixing belt) is not overheated, leading to suppression of thermal degradation of the intermediate transfer belt 401.

In this example, specifically, the registration rollers 465 serves as the upstream conveying unit and the transferring/fixing roller 404 and the pressure roller 468 serve as the downstream conveying unit. In the similar manner to the sheet conveying device shown in FIG. 14, a counterbalancing torque can be applied to the downstream conveying unit.

As the sheet-entry-detecting unit that estimates entry of the sheet S into the transferring/fixing unit 466, a sheet detecting sensor 485 is arranged between the registration rollers 465 and the pressure roller 468. The timing of entering the sheet S into the transferring/fixing roller 404 and the pressure roller 468 on the downstream side can be estimated based on a detection signal from the sheet detecting sensor 485. Alternatively, an operation start signal of the registration rollers 465 can be used instead of the sheet detecting sensor 485.

As explained in the above, applying the present invention to the electrophotographic image forming apparatus that includes the sheet conveying unit enables suppression of the speed fluctuation of a pair of rollers when a thick sheet enters into a secondary-transfer unit, a fixing unit, and a transferring/fixing unit. This suppression of the speed fluctuation of the rollers at the secondary-transfer unit can prevent the speed fluctuation of the intermediate transfer belt and image distortion at the primary-transfer unit, thereby effectively preventing color shift of different color images to be superimposed. As a result, a high-quality full-color image is attainable. In addition, suppression of the speed fluctuation of a pair of rollers at the fixing unit enables prevention of such as frictional distortion of unfixed toner image at the secondary-transfer unit on the upstream side. Furthermore, suppression of the speed fluctuation of the rollers at the transferring/fixing unit can prevent the speed fluctuation in the intermediate transfer unit, leading to prevention of possible image distortion at the primary-transfer unit or at the secondary-transfer unit. Consequently, a high-quality full-color image is attainable.

The present invention has been exemplary explained with reference to the accompanying drawings; however the present invention is not limited thereto. The two sheet conveying units are applied in the above embodiments; however, equal to or more than three sheet conveying units can be applied to an image forming apparatus. Alternative constructions of such as a sheet conveying unit including an endless belt can be employed. In such a case, the endless belt can be arranged either on the driving side or on the driven side. The measuring unit to obtain the torque data of the sheet conveying unit can employ any appropriate methods and constructions. The construction of the driving method that drives the sheet conveying unit is optional. Moreover, the calculation method for the control target value and the conversion process from the calculated control target value into the control command value is explained as an example.

The present invention is not limited to the drum type for the image carriers, and belt-type image carriers are usable. The construction of the image forming unit, the order of the arrangement of the image forming units for different colors in the tandem type image forming apparatus, and the like are optional. Use of the tandem type is not the only option; however, the type configured with a plurality of developing units arranged around a single photosensitive element or the type configured with a revolver developing unit can be employed. Moreover, the present invention is applicable to a three-color image forming apparatus, a two-color image forming apparatus, and a monochrome image forming apparatus. If employing an intermediate transfer unit, the indirect transfer method is not the only way, and a direct transfer method is adoptable. The image forming apparatus is not limited to the copier or the printer, and a facsimile or a multifunction product (MFP) can be employed.

Furthermore, the sheet conveying device according to the above embodiments of the present invention is not limitedly applied to an image forming apparatus, and is applicable to any kinds of apparatuses that convey a sheet-like member, such as, although not limited, a reading unit including a scanner and an ADF, as well as an image forming apparatus that includes the scanner and the ADF.

According to one aspect of the present invention, the speed fluctuation at the time of entry of a sheet into the downstream sheet conveying unit is preventable based on the load torque of the upstream sheet conveying unit. Moreover, the accuracy of the estimation of the load torque is higher than the torque control method based on the pre-stored torque data, so that the speed fluctuation is preventable highly accurately. Furthermore, a larger-capacity storage unit is not needed.

According to another aspect of the present invention, there is a time-lag in conveying a sheet between the upstream side and the downstream side, so that time is ensured for processing data by the torque estimation unit and for starting to actually apply the torque to the downstream conveying unit.

According to still another aspect of the present invention, the load torque at the downstream sheet conveying unit can be accurately counterbalanced based on the load torque that is actually measured, and the load on the control unit required for estimating the torque can be suppressed.

According to still another aspect of the present invention, even for a construction without a torque measuring unit, the load torque at the downstream sheet conveying unit can be estimated and the driving torque of the downstream sheet conveying unit can be controlled, thereby suppressing the speed fluctuation at the downstream sheet conveying unit.

According to still another aspect of the present invention, the current value of the driving motor for the upstream conveying unit can be converted into the sheet nipping torque of the driving roller of the upstream conveying unit.

According to still another aspect of the present invention, the greater degree of design freedom is attainable. In addition, considering the forward pressing force by the recoding medium (sheet-like member) enables estimating the nipping torque of the recoding medium at the downstream conveying unit when the forward pressing force by the recoding medium differs between at the upstream conveying unit and at the downstream conveying unit.

According to still another aspect of the present invention, the timing of entry of the recoding medium into the downstream conveying unit can be estimated based upon the detection signal by the sheet detecting unit, so that controlling with higher accuracy is performable.

According to still another aspect of the present invention, the timing of entry of the recoding medium into the downstream conveying unit can be estimated based upon the driving start signal for the upstream conveying unit even if such a sheet detecting unit is not arranged.

According to still another aspect of the present invention, controlling the driving torque of the downstream conveying unit enables preventing image distortion and outputting higher quality image.

According to still another aspect of the present invention, suppression of the speed fluctuation of the sheet conveying unit at the image transfer unit enables preventing distortion in the transferred image and outputting higher quality image.

According to still another aspect of the present invention, suppression of the speed fluctuation of the fixing unit enables preventing distortion in the unfixed image and outputting higher quality image. Furthermore, uneven lubrication on the rollers is preventable.

According to still another aspect of the present invention, suppression of the speed fluctuation of the sheet conveying unit at the transferring/fixing unit that performs transferring and fixing of the image concurrently enables preventing image distortion and outputting higher quality image.

According to still another aspect of the present invention, performing the control only when feeding thick sheets enables reducing the load on the control unit and reducing power wastage.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet conveying device, comprising:

a first sheet conveying unit that is located upstream in a sheet conveying direction and that includes a first driving roller and a first driven roller;

a driving source for driving the first driving roller;

a second sheet conveying unit that is located downstream in the sheet conveying direction, that includes a second driving roller and a second driven roller, and of which a driving torque is controllable;

a torque estimation unit that, based upon a driving current of the driving source and a first load torque generated at a time that a sheet-like member passes through a first nip between the first driving roller and the first driven roller estimates a second load torque generated at a time that the sheet-like member passes through a second nip between the second driving roller and the second driven roller; and a control unit that controls the driving torque such that the second load torque is counterbalanced by applying a counterbalancing torque in synchronization with a timing of entry of the sheet-like member into the second nip, wherein the torque estimation unit estimates the second load torque taking into account a torque constant of the driving source and a reduction ratio from the driving source to the first driving roller.

2. The sheet conveying device according to claim 1, further comprising a torque measuring unit that measures the first load torque.

3. The sheet conveying device according to claim 1, further comprising:

a sheet detecting unit arranged on a feed path, wherein the control unit calculates the timing of entry of the sheet-like member into the second sheet conveying unit based on a signal indicative of detection of the sheet-like member by the sheet detecting unit.

4. The sheet conveying device according to claim 1, wherein the control unit calculates the timing of entry of the sheet-like member into the second sheet conveying unit based on a driving start signal for the first sheet conveying unit.

5. A sheet conveying device, comprising:

a first sheet conveying unit that is located upstream in a sheet conveying direction and that includes a first driving roller and a first driven roller;

a second sheet conveying unit that is located downstream in the sheet conveying direction, that includes a second driving roller and a second driven roller, and of which a driving torque is controllable;

a torque estimation unit that, based upon a first load torque generated at a time that a sheet-like member passes through a first nip between the first driving roller and the first driven roller, estimates a second load torque generated at a time that the sheet-like member passes through a second nip between the second driving roller and the second driven roller; and a control unit that controls the driving torque such that the second load torque is counterbalanced by a counterbalancing torque in synchronization with a timing of entry of the sheet-like member into the second nip, wherein the torque estimation unit estimates the second load torque taking into account, at least one of radiuses of the first driving roller and the second driving roller, radiuses of the first driven roller and the second driven roller, pressing forces between the first driving roller and the first driven roller and between the second driving roller and the second driven roller, and a forward pressing force by the sheet-like member.

6. An image forming apparatus comprising a sheet conveying device including a first sheet conveying unit that is located upstream in a sheet conveying direction and that includes a first driving roller and a first driven roller;

a driving source for driving the first driving roller;

a second sheet conveying unit that is located downstream in the sheet conveying direction, that includes a second driving roller and a second driven roller, and of which a driving torque is controllable;

a torque estimation unit that, based upon a driving current of the driving source and a first load torque generated at a time that a sheet-like member passes through a first nip between the first driving roller and the first driven roller, estimates a second load torque generated at a time that the sheet-like member passes through a second nip between the second driving roller and the second driven roller; and a control unit that controls the driving torque such that the second load torque is counterbalanced by applying a counterbalancing torque in synchronization with a timing of entry of the sheet-like member into the second nip, wherein the torque estimation unit estimates the second load torque taking into account a torque constant of the driving source and a reduction ratio from the driving source to the first driving roller.

7. The image forming apparatus according to claim 6, wherein the second sheet conveying unit is an image transfer unit that transfers an image onto the sheet-like member, and the first sheet conveying unit is a registration unit that feeds the sheet-like member in synchronization with the image to be transferred at the image transfer unit.

8. The image forming apparatus according to claim 6, wherein the first sheet conveying unit is an image transfer unit that transfers an image onto the sheet-like member, and the second sheet conveying unit is a fixing unit that fixes the image transferred onto the sheet-like member to the sheet-like member.

9. The image forming apparatus according to claim 6, wherein the second sheet conveying unit is a transferring/fixing unit that concurrently performs transferring and fixing of an image onto the sheet-like member, and the first sheet conveying unit is a registration unit that feeds the sheet-like member in synchronization with the image to be transferred and fixed at the transferring/fixing unit.

10. The image forming apparatus according to claim 6, wherein the control unit controls to apply the counterbalancing torque to the second sheet conveying unit only when a sheet-like member is relatively thick.

* * * * *